US007224320B2

(12) United States Patent
Cook

(10) Patent No.: US 7,224,320 B2
(45) Date of Patent: May 29, 2007

(54) SMALL WAVE-GUIDE RADIATORS FOR CLOSELY SPACED FEEDS ON MULTI-BEAM ANTENNAS

(75) Inventor: Scott J. Cook, Woodstock, GA (US)

(73) Assignee: ProBrand International, Inc., Marietta, GA (US)

( * ) Notice: Subject to any disclaimer, the term of this patent is extended or adjusted under 35 U.S.C. 154(b) by 0 days.

(21) Appl. No.: 11/132,761

(22) Filed: May 18, 2005

(65) Prior Publication Data

US 2005/0259025 A1 Nov. 24, 2005

Related U.S. Application Data

(60) Provisional application No. 60/572,080, filed on May 18, 2004, provisional application No. 60/571,988, filed on May 18, 2004.

(51) Int. Cl.
*H01Q 13/00* (2006.01)

(52) U.S. Cl. ..... 343/772; 343/776; 343/786

(58) Field of Classification Search ..... 343/772, 343/779, 776
See application file for complete search history.

(56) References Cited

U.S. PATENT DOCUMENTS

| | | | | |
|---|---|---|---|---|
| 3,936,835 A | 2/1976 | Phelan | | |
| 5,614,916 A * | 3/1997 | Mizuguchi | ..... | 343/786 |
| 5,860,056 A * | 1/1999 | Pond | ..... | 455/13.3 |
| 6,388,633 B1 * | 5/2002 | Imaizumi et al. | ..... | 343/776 |
| 6,434,384 B1 * | 8/2002 | Norin et al. | ..... | 455/429 |
| 6,580,391 B1 | 6/2003 | Kepley et al. | | |
| 6,661,390 B2 * | 12/2003 | Gau et al. | ..... | 343/786 |
| 2002/0075196 A1 * | 6/2002 | Hou et al. | ..... | 343/782 |

FOREIGN PATENT DOCUMENTS

| | | |
|---|---|---|
| DE | G 90 13 455.9 | 3/1991 |
| JP | 57157603 | 9/1982 |
| WO | WO 01/67555 A2 | 9/2001 |

OTHER PUBLICATIONS

Eine Schussel fur funf Satelliten. FUNKSCHAU, Jun. 14, 1991, Munich, Germany.

* cited by examiner

*Primary Examiner*—Trinh Vo Dinh
(74) *Attorney, Agent, or Firm*—Michael J. Mehrman; Mehrman Law Office PC

(57) ABSTRACT

A relatively low cost, easy to install and aesthetically pleasing digital video broadcast from satellite (DVBS) elliptical horn antenna designed to receive satellite television broadcast signals with circular polarity. This type antenna may be implemented as a multi-beam, multi-band antenna with closely spaced antenna feed horns operable for simultaneously receiving signals from multiple satellites that are closely spaced from the perspective of the antenna.

16 Claims, 11 Drawing Sheets

SMALL WAVE-GUIDE RADIATORS FOR CLOSELY SPACED FEEDS ON MULTI-BEAM ANTENNAS

REFERENCE TO RELATED APPLICATIONS

This application claims priority to commonly-owned copending U.S. Provisional Patent Application Ser. No. 60/572,080 entitled "Small Wave-Guide Radiators For Closely Spaced Feeds on Multi-Beam Antennas" filed May 18, 2004, which is incorporated herein by reference; and U.S. Provisional Patent Application Ser. No. 60/571,988 entitled "Circular Polarization Technique for Elliptical Horn Antennas" filed May 18, 2004, which is also incorporated herein by reference.

TECHNICAL FIELD

The present invention is generally related to antenna systems designed to receive broadcast signals with circular polarity and, more particularly, is directed to digital video broadcast satellite (DVBS) antenna systems.

SUMMARY OF THE INVENTION

An increasing number of applications are requiring systems that employ a single antenna designed to receive from and/or transmit to multiple sources simultaneously (multiple satellites in particular). In cases where the satellites are very close this creates a challenge for reflector antenna systems often resulting in compromised performance and/or increased cost and complexity. On a given reflector system a feed (horn or radiating element) is needed for each satellite to be received from (or transmitted to).

The difficulty arises because relatively small spacing between satellites requires relatively small spacing between feeds. These small feed spacing limits the size of the feed and other parameters making it difficult to achieve good of even adequate antenna performance and cost. Previously, considerable compromises were made on single reflector antenna systems. FIG. 1 provides an example of a single reflector with 3 closely spaced speeds for simultaneous reception from 3 satellites.

A specific example of where this challenge arises are in systems requiring simultaneous reception from a Ku BSS band satellite at 101° as well as one or more Ku BSS band or Ka band satellites are about 2 deg (or less) away from the Ku BSS satellite. The Ka band and Ku BSS satellites have lower EIRP (power density on the ground) and are much closer to potential interference sources (generally around 2°). With this in mind the Ka band and/or Ku band BSS performance requirements are usually the dominated factors in determining antenna size and shape. Therefore little or no compromises are acceptable in the design and fabrication of the Ka band or Ku band FSS feeds, so the Ka band and Ku band BSS feed horns should not be made inordinately small. On the other hand the Ku-DBS band horn can be made relatively small because the dish size required for Ka or Ku BSS is oversized for the DBS service (with it's higher EIRP).

Current Compromised Approaches:

Some systems using modestly sized feeds limit how close the feeds can be placed such that the feeds are farther apart than the ideal feed separation resulting in wider than ideal angular separation between the antenna beams associated with each feed. This results in an angular bore sight errors on one or more of the beams. FIG. 2 shows this error and resulting loss in power.

Currently some DBS feed approaches use small circular wave-guides without employing dielectric material. Although fairly small there are still inherent limits on how small these circular wave-guide feeds can be made and correspondingly how close adjacent feeds can be placed. This in turn can cause the bore-sight errors and performance degradations discussed above. FIGS. 3*a,b* show a typical situation where circular radiators are used next to elliptical or rectangular feed(s). In this example very little space is available between the feeds. They are probably to close for die-casting the wall needed between them. Typically 0.05" thickness is needed for the wall.

Other systems introduce dielectric material into the DBS feed(s) in order to reduce size. These dielectric feeds can generally be made small enough to allow the feeds to be placed at the correct location (separation) to eliminate bore sight errors but dielectric material introduces loss sacrificing antenna gain and noise temperature. Cost and manufacturing complexity is also generally increased with the addition of a dielectric material. In addition many implementations extend the dielectric material well beyond the circular wave-guide in order to improve the feeds directivity and match. The phase center of such a feed is usually somewhere between the end of the dielectric and the metal wave-guide. This can pose a problem to the adjacent feeds if a portion of the dielectric feed partially blocks the path the adjacent feed(s). FIGS. 4*a,b* show how dielectric shrinks the circular feed diameter providing more space between the feeds. It also shows how the dielectric sticks out in front of the feeds causing blockage of energy into the adjacent feeds at some angles of incidence.

Increasing the focal length (or f/d=focal length to diameter ratio) is another technique commonly used to increase the feed spacing required for a given satellite spacing. However increasing the focal length makes the feed support arm longer increasing cost and/or degrading mechanical stability. In addition for longer focal length antenna's feeds must be either larger (increasing cost) or gain, noise temperature and pattern performance will degrade due to excessive spill over (energy spillover the reflector due to inadequately directive feeds).

Dual reflector systems can be used to increase feed spacing and improve performance but these systems generally increase cost and complexity. There is, therefore, a continuing need for a multi-beam, multi-band antenna with closely spaced antenna feed horns operable for simultaneously receiving signals from multiple satellites that are closely spaced from the perspective of the antenna.

SUMMARY OF THE INVENTION

The invention provides a solution to the problems discussed above by using wave guide structures that are narrower than circular wave guide structures particularly in the direction that allows additional feeds to be placed very closely in order to reduce or eliminate bore sight errors without the introduction of dielectric material and without substantial increases in focal length. So this invention immediately minimizes cost and improves performance by eliminating dielectric losses and keeping the feed support arm short. In addition this invention has several possible embodiments most of which are easily manufactured in high volume because they can be integrated directly into the LNBF die-cast housing. Furthermore for circular polarity most of the embodiments of this invention allow a CP polarizer to also be integrated directly into the housing. This invention has obvious advantages on single reflector systems but could also be used in dual reflector systems where feed spacing is still a concern.

DETAILED DESCRIPTION OF THE EMBODIMENTS

Figure 1A:
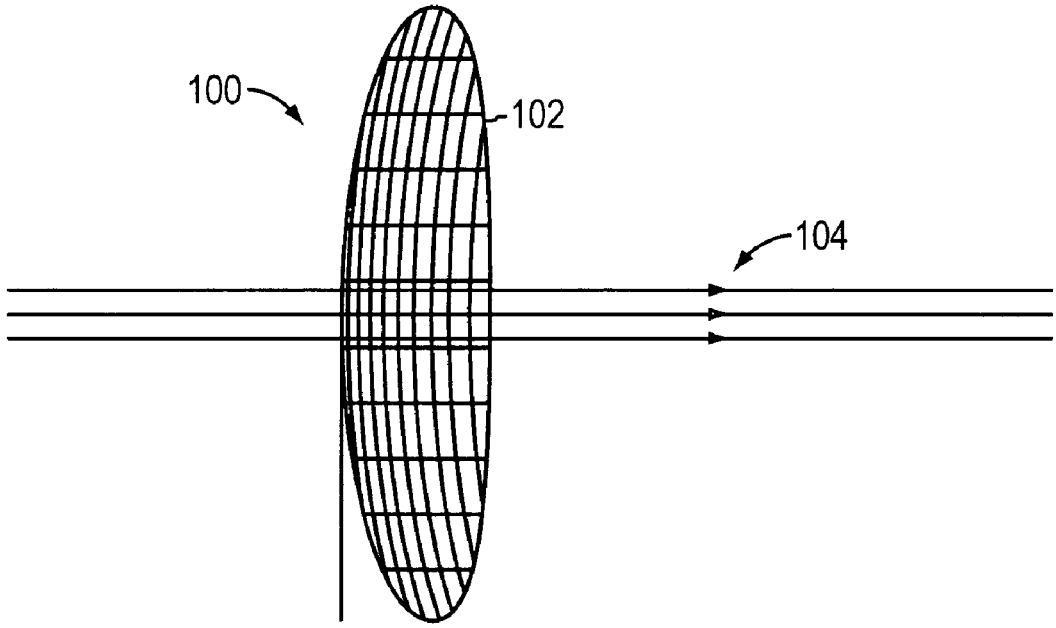
FIG. 1*a* is a top view of an antenna that includes three closely antenna feed horns.

The embodiments of the present invention meet the challenge of designing and manufacturing a single antenna with multiple closely spaced feed horns for simultaneous reception from (and/or transmission to) multiple satellites that are closely spaced from the perspective of the antenna. The feed horns and associated circular polarity antenna systems for multiple-beam, multi-band antennas are designed to achieve good circular polarity performance over broad and multiple frequency bands.

In general, elliptically and other shaped horn apertures are described in the examples in this disclosure, however this invention can be applied to any device that introduces phase differentials between orthogonal linear components that needs to be compensated for in order to achieve good CP conversion and cross polarization (Cross polarization) isolation including but not limited to any non-circular beam feed, rectangular feeds, oblong feeds, contoured corrugated feeds, feed radomes, specific reflector optics, reflector radomes, frequency selective surfaces etc.

To simplify the discussions, examples in this disclosure primarily refer to reception or signals and generally referred to a single circular polarity. However reciprocity applies to all of these embodiments given they are generally low loss passive structures. Furthermore the horns, CP polarizers and phase compensation sections obviously support both senses of CP (RHCP and LHCP). If both senses are impinging on the horn then they will be converted to 2 orthogonal linear polarities that can be easily picked up with 2 orthogonal probes and/or slots etc. So the approaches described in embodiments 1 and 2 can be used for systems transmitting and/or receiving power in any combination of circular polarities: single CP or Dual CP for each band implemented including multiple widely spaced frequency bands.

It should be pointed out that for simplicity, specific phase values were often given in the examples, but the phase compensation concepts explained above are general. For example, the following applies to embodiment #2: If the elliptical horn introduces X degrees phase differential then the opposite slop phase differential section should introduce 90-X degrees so that the total introduced phase differential is 90 degrees=X −(90-X).

For simplicity the inventor provides examples using a nominal 90 degrees phase differential between orthogonal linear components as the target for achieving CP conversion however it is understood that a nominal −90 degrees or any odd integer multiple of −90 or 90 degrees will also achieve good CP ( . . . −630, −450, −270, −90, 90, 270, 450, 630 etc.) and this invention covers those cases as well. As an example for embodiment 2 the horn could introduce a 470 degrees phase differential and the opposite phase slop section could introduce a −200 degrees phase differential resulting in a total 270 degrees phase differential.

In addition, a skilled antenna designer will understand that the term "CP polarizer" is not limited to a device achieving a theoretically perfect conversion from circular polarity to linear polarity, but instead includes devices that achieves a conversion from circular polarity to linear polarity within acceptable design constraints for its intended application.

Figure 1B:
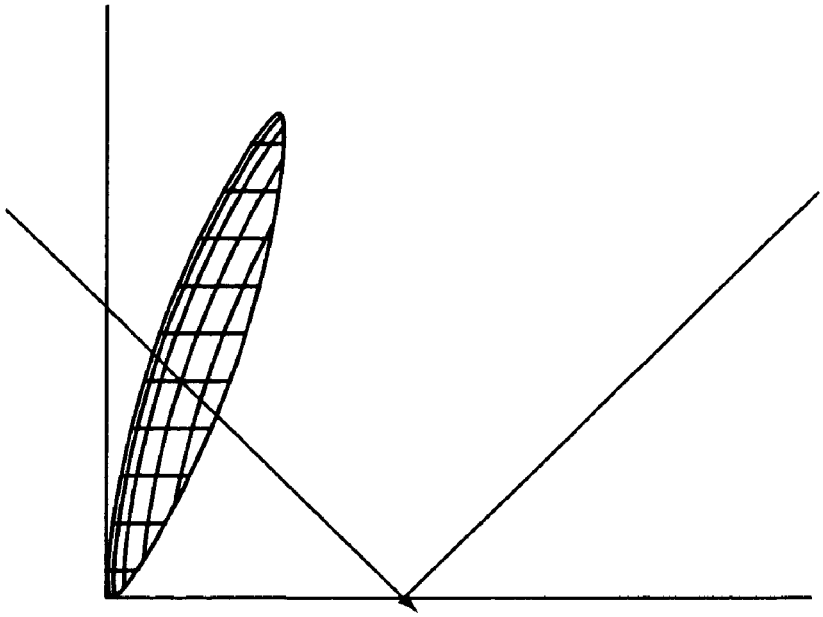
FIG. 1*b* is side view of the antenna of FIG. 1.

FIGS. 1*a-b* is a top view of an antenna 100 that includes three closely antenna feed horns 104*a-c*.

Figure 2:
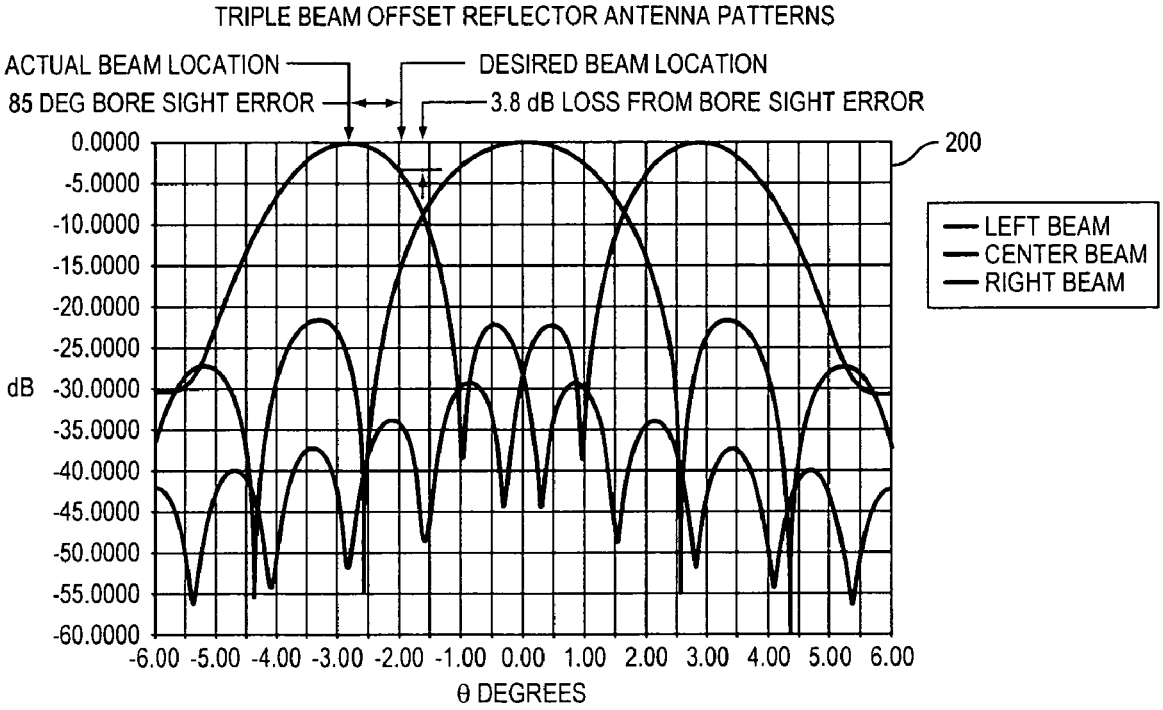
FIG. 2 is a graphical illustration of boresight error caused by antenna feed offset in the antenna of FIG. 1.

FIG. 2 is a graphical illustration 200 of boresight error caused by antenna feed offset in the antenna 100.

Figure 3A:
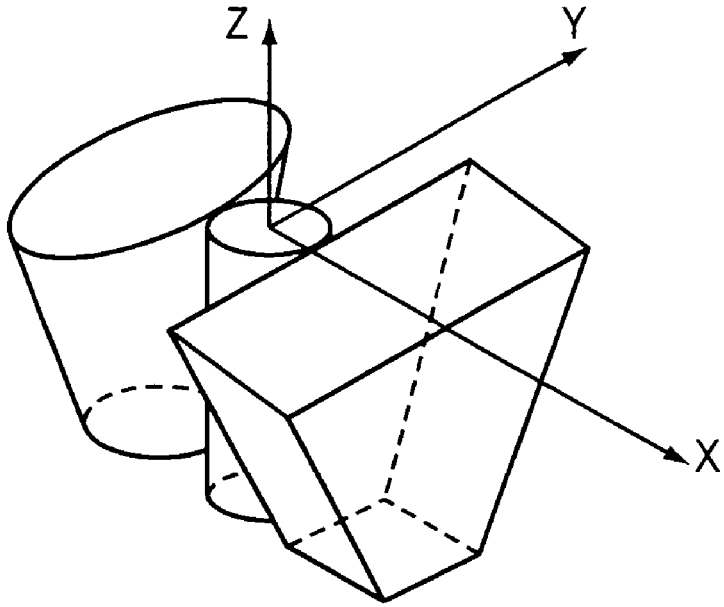
FIG. 3*a* is a conceptual perspective side view of a three-horn antenna feed block including a round feed horn located between an elliptical feed horn and a rectangular feed horn.
Figure 3B:
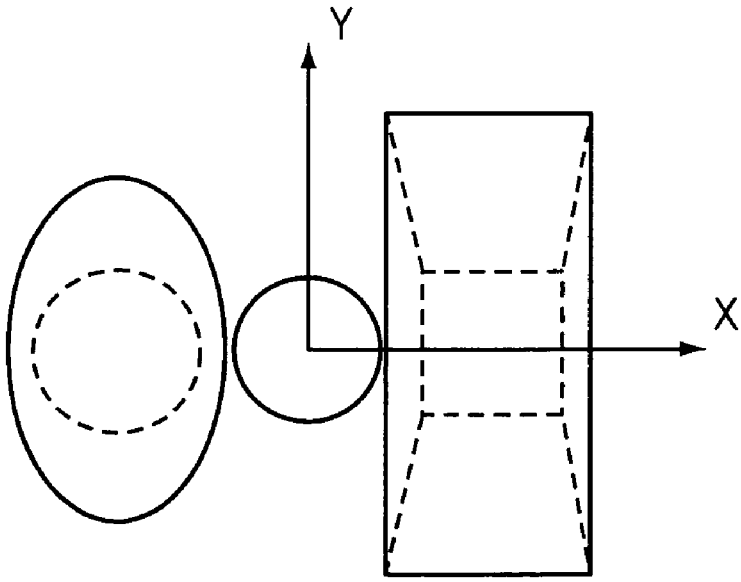
FIG. 3*b* is a front view of the three-horn antenna feed block of FIG. 3*a*.

FIGS. 3*a-b* is how a three-horn antenna feed block 300 including a round feed horn 302 located between an elliptical feed horn 304 and a rectangular feed horn 306.

Figure 4A:
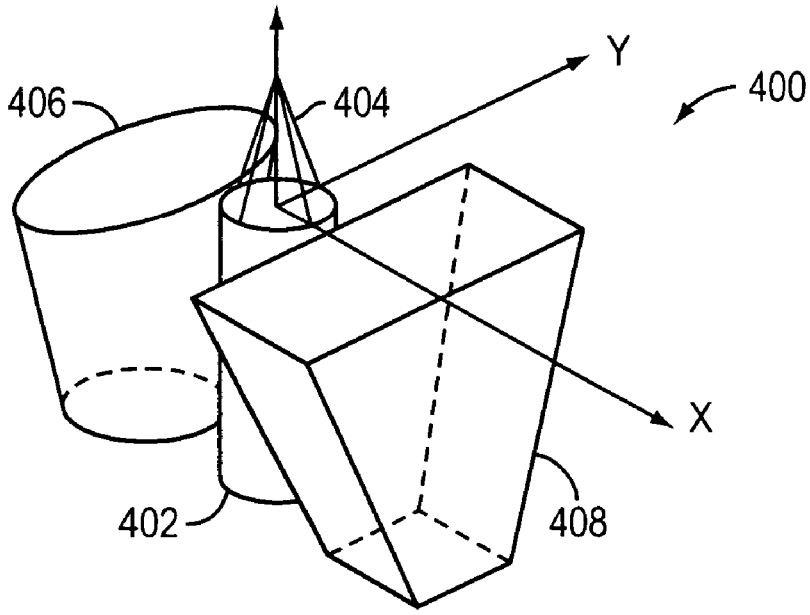
FIG. 4*a* is a conceptual perspective side view of a three-horn antenna feed block including a round feed horn with a dielectric cone located between an elliptical feed horn and a rectangular feed horn.
Figure 4B:
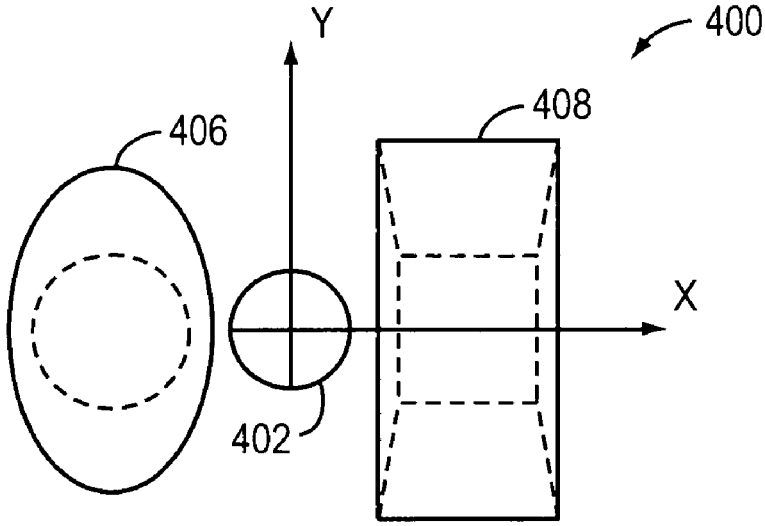
FIG. 4*b* is a front view of the three-horn antenna feed block of FIG. 4*a*.

FIGS. 4*a-b* show a three-horn antenna feed block 400 including a round feed horn 402 with a dielectric cone 404 located between an elliptical feed horn 406 and a rectangular feed horn 408.

Figure 5:
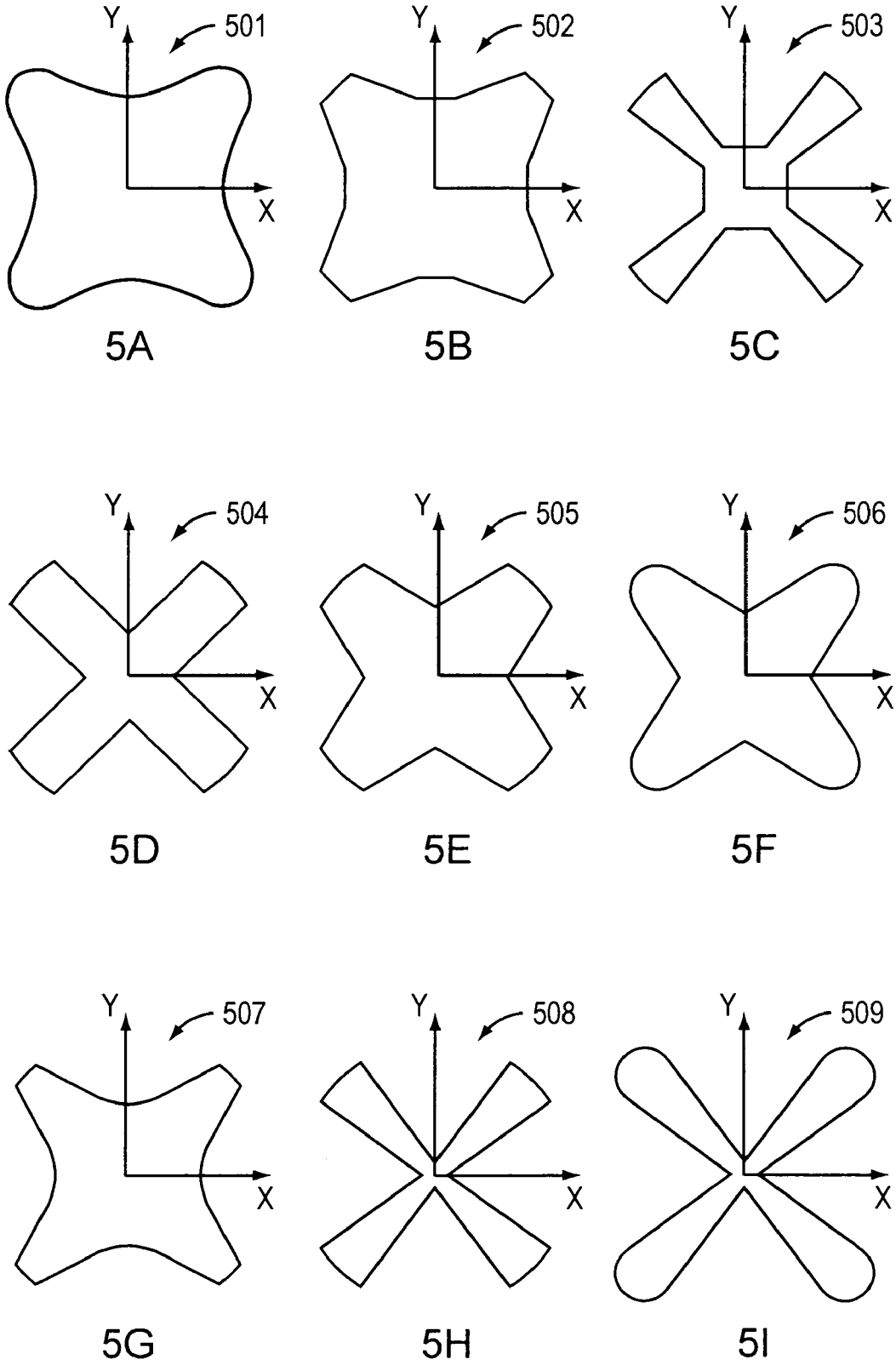
FIG. 5*a-w* excluding FIGS. 5*l* and 5*o*, consisting three drawing sheets, shows conceptual front views of 21 possible antenna feed horn aperture configurations.
Figure 5:
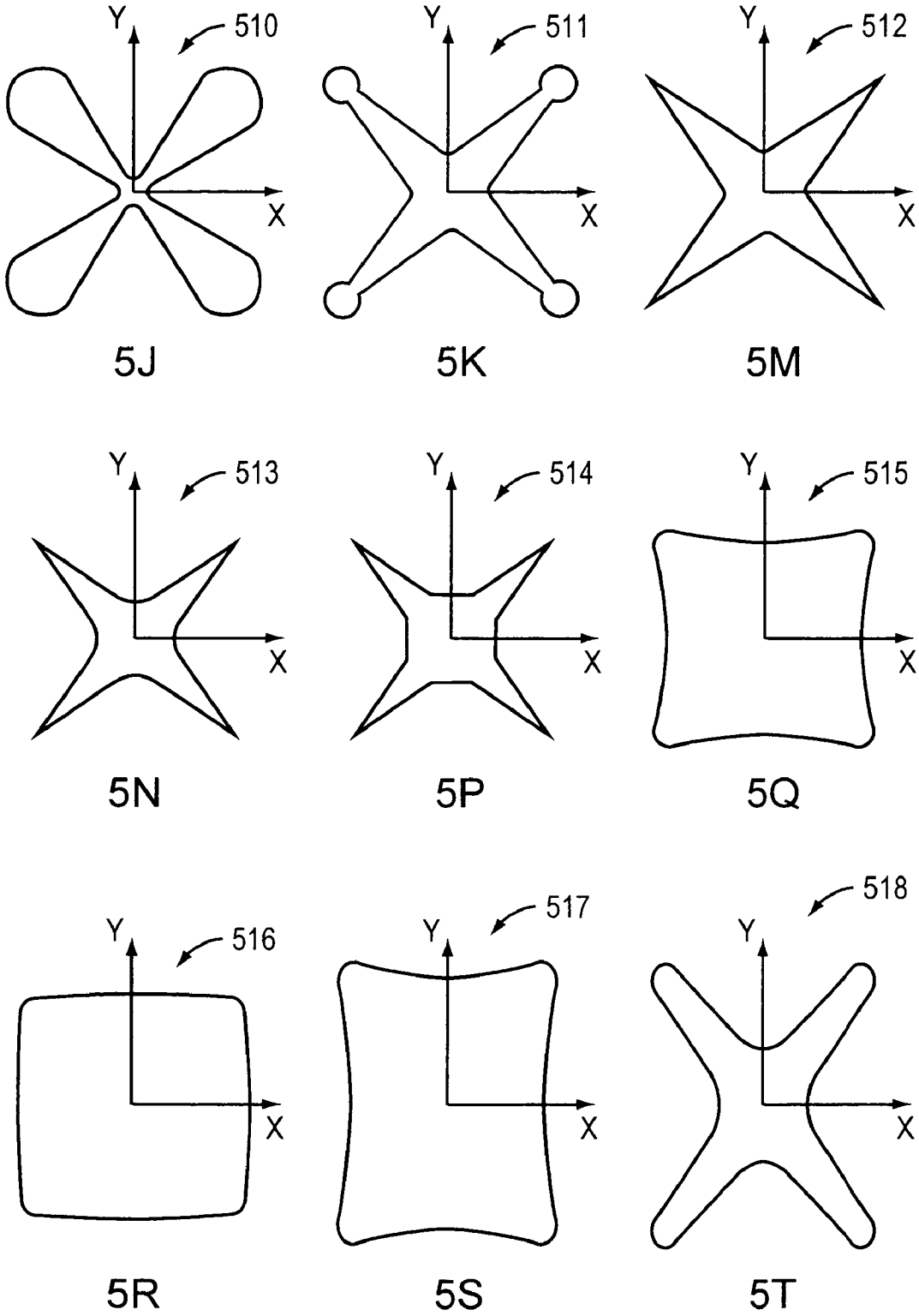
Figure 5:
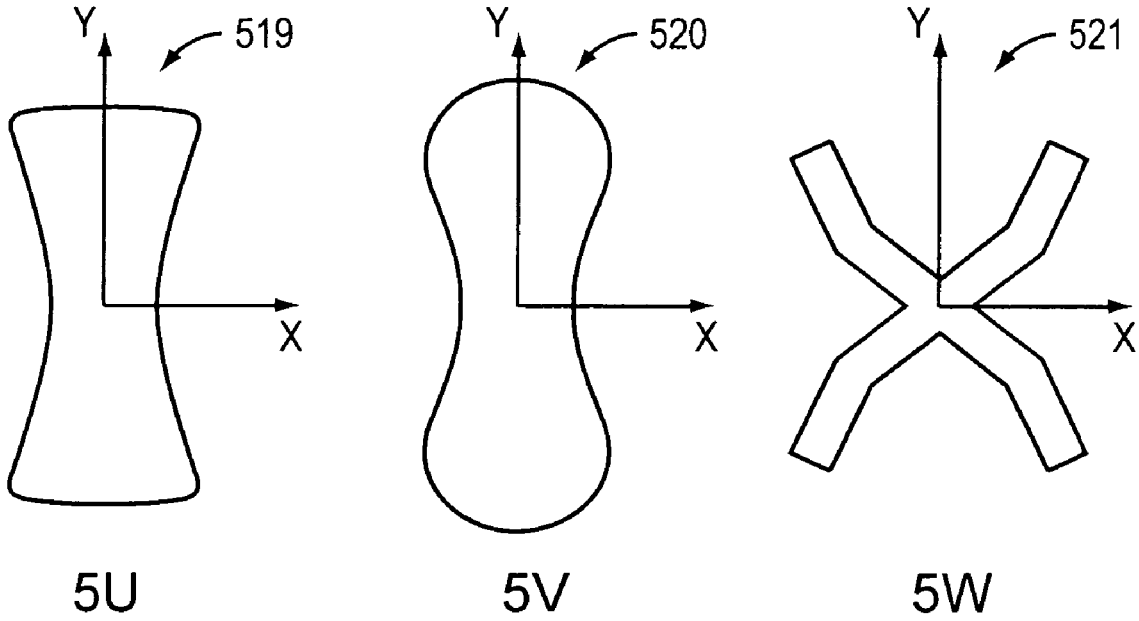

FIGS. 5*a-w* excluding FIGS. 5*l* and 5*o*, consisting three drawing sheets, shows conceptual front views of 21 possible antenna feed horn aperture configurations 501 through 521.

Figure 6A:
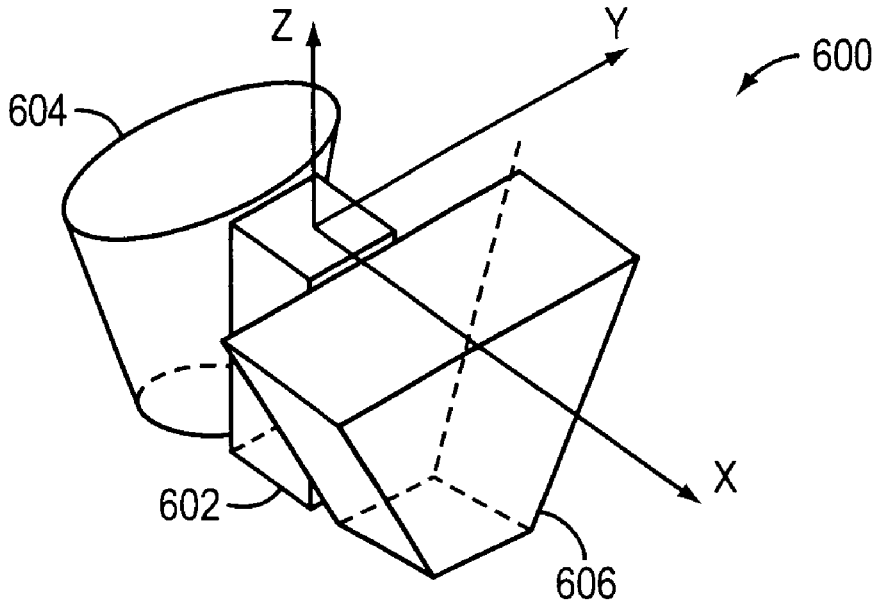
FIG. 6*a* is a conceptual perspective side view of a three-horn antenna feed block including a square feed horn located between an elliptical feed horn and a rectangular feed horn.
Figure 6B:
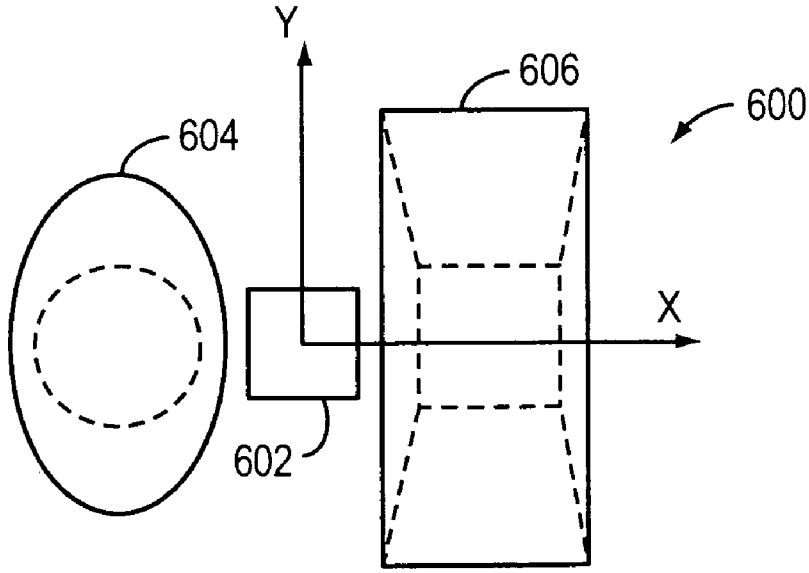
FIG. 6*b* is a front view of the three-horn antenna feed block of FIG. 6*a*.

FIGS. 6*a-b* show a three-horn antenna feed block 600 including a square feed horn 602 located between an elliptical feed horn 604 and a rectangular feed horn 606.

Figure 7A:
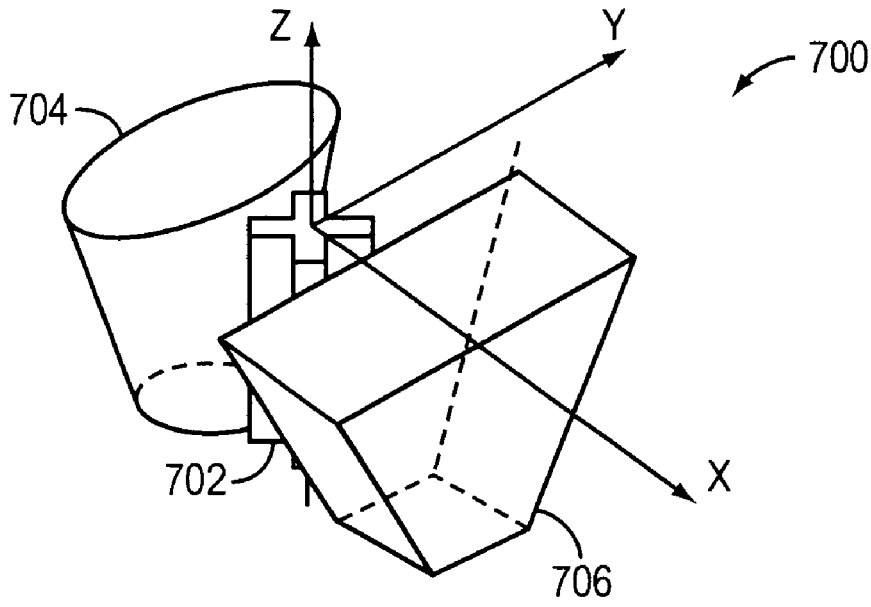
FIG. 7*a* is a conceptual perspective side view of a three-horn antenna feed block including a cross shaped feed horn located between an elliptical feed horn and a rectangular feed horn.
Figure 7B:
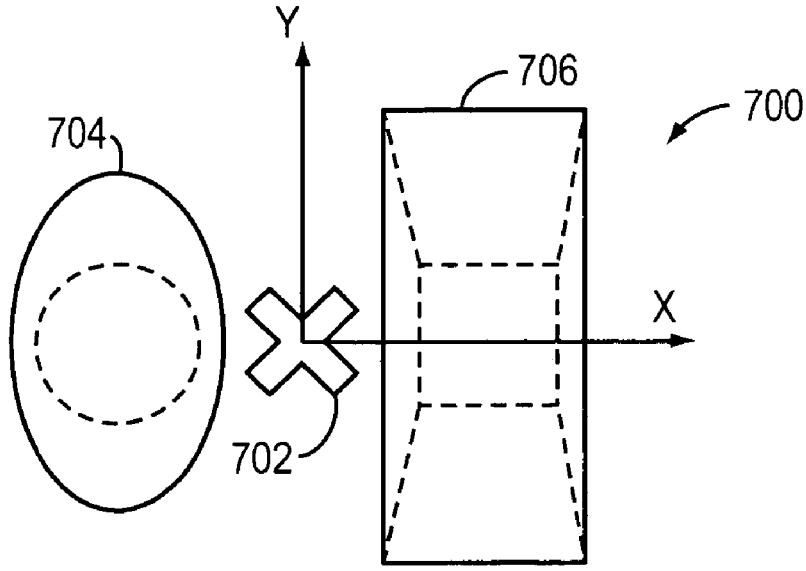
FIG. 7*b* is a front view of the three-horn antenna feed block of FIG. 7*a*.

FIGS. 7*a-b* show a three-horn antenna feed block 700 including a cross shaped feed horn 702 located between an elliptical feed horn 704 and a rectangular feed horn 706.

Figure 7C:
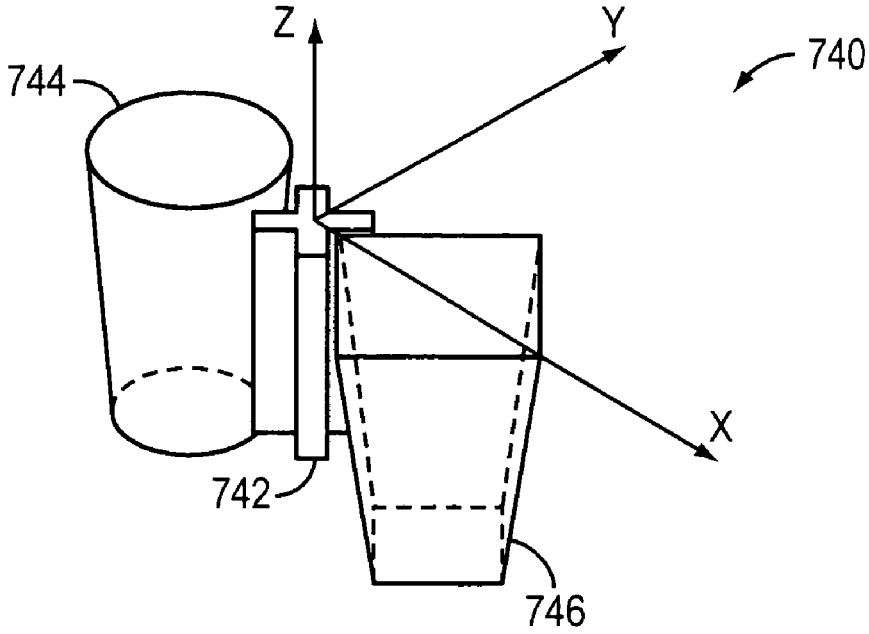
FIG. 7*c* is a conceptual perspective side view of a three-horn antenna feed block including a cross shaped feed horn located between an elliptical feed horn and a square feed horn.
Figure 7D:
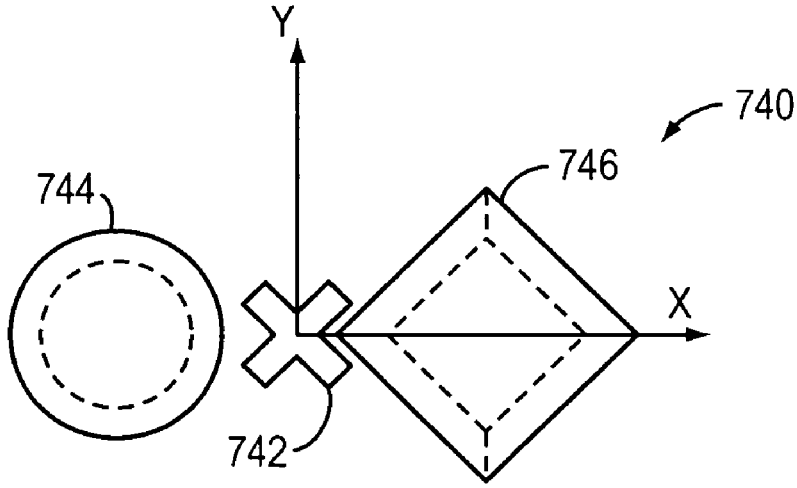
FIG. 7*d* is a front view of the three-horn antenna feed block of FIG. 7*c*.

FIGS. 7*c-d* show a three-horn antenna feed block 740 including a cross shaped feed horn 742 located between an elliptical feed horn 744 and a square or diamond feed horn 746. In this embodiment, the square or diamond shaped feed horn 746 has been rotated so that a corner of the feed horn fits into a corner of the cross shaped feed horn 742 to further reduce the feed horn spacing in this embodiment.

Figure 8A:
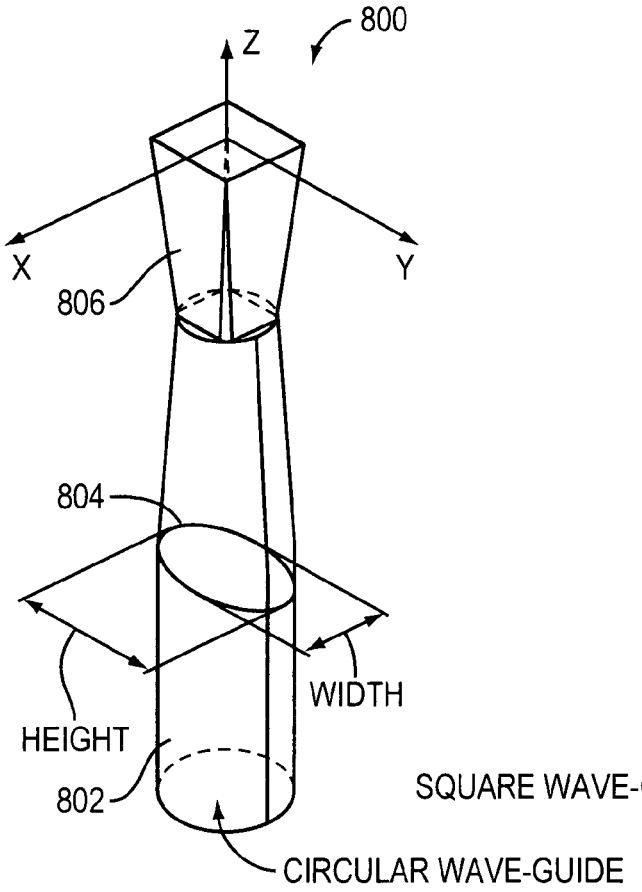
FIG. 8*a* is a perspective view of a small square horn with a circular polarity polarizer that transitions from circular to elliptical and back to circular waveguide.

FIG. 8*a* shows a horn and polarizer assembly 800 including a small square horn 806 with a circular polarity transition/polarizer section 804 that transitions from circular to elliptical and back to circular waveguide at the circular waveguide port 802.

Figure 8B:
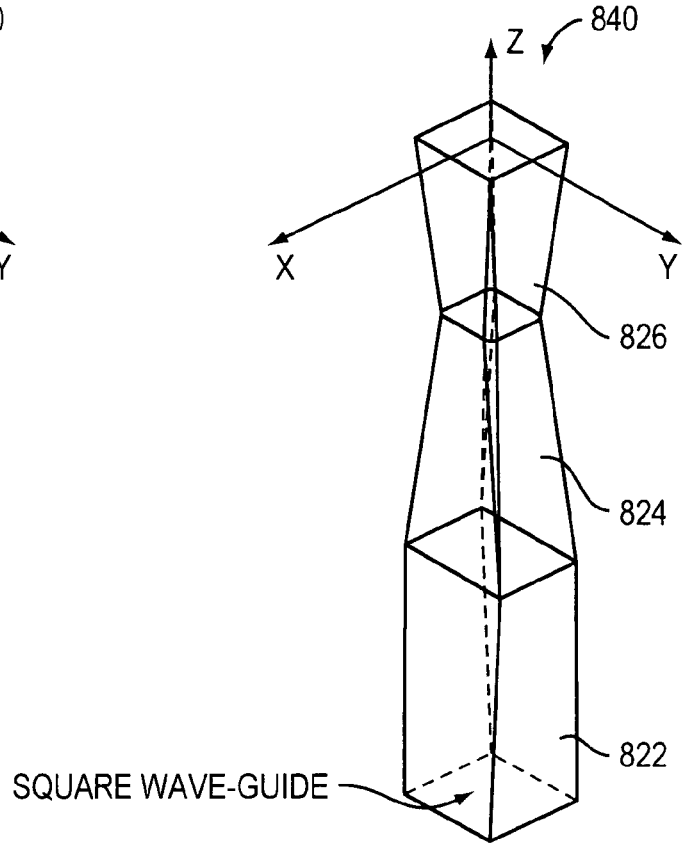
FIG. 8*b* is a perspective view of a small square horn with a circular polarity polarizer that transitions from square to rectangular and back to square waveguide.

FIG. 8*b* shows a horn and polarizer assembly 840 including a small square horn 826 with a circular polarity transition/polarizer section 824 that transitions from square to rectangular and back to square waveguide at the square waveguide port 822.

BASIC DESCRIPTION/PRINCIPLES OF THIS INVENTION

As discussed above many other approaches use circular wave-guide radiators when size and spacing is limited. However at a given frequency the circular wave-guide can only be made so small before it's dominate mode of propagation is severely attenuated.

The basic principle of this invention is the use of other wave-guide geometries that can be made narrower than circular radiators, particularly in the direction to allow adjacent feeds to be placed closer together. The inventor recognized that a variety of geometries can be used to accomplish this including simple squares, cross or star structures, with sharp or generously radiuses corners as depicted in FIGS. 5*a-w* excluding FIGS. 5*l* and 5*o*. As can be seen many of these structures are quite simple/elegant and would be relatively easy to produce and integrate into an LNBF casting. The shapes range from distinctively cross-shaped geometries to nearly square, and some are even oblong. All allow adjacent feeds to be put closer than a circular feed would allow, because they can have a smaller width in that direction without significantly attenuating the signal in comparison to the traditional circular wave guide that has a relative high cutoff frequency.

So in many cases these wave-guide structures will allow for sufficiently small (narrow) feed sizes and close feed spacing, however if needed dielectrics could be employed to further reduce the width of the feed.

FIGS. 6*a,b* show an embodiment of this invention that uses a square radiator. It could easily transition into a circular polarity polarizer (for converting 2 CP signals into 2 linear modes) by gradually changing from the symmetric wave guide structure (near the square radiator) to a slightly asymmetric structure to introduce the proper phase shifts of the 2 orthogonal linear components (that make up a given circular polarity signal) and then by finally transitioning to a circular wave guide convenient for direct integration into an LNBF. In this example the square radiator was conservatively chosen to be 0.532 inches across corresponding to a cut off frequency of 11.1 GHz which is well below the frequency band of operation (12.2-12.7 GHz). This provides considerably more space between the feeds (or the feeds could be placed closer together). A circular wave-guide of that same diameter (0.532") has a cut off frequency of 13.0 GHz and would therefore not even operate in the desired band. A circular wave-guide would have to be 0.623" in diameter in order to have a cut off frequency of 11.1 GHz. 0.623" is 17% increase in width over the square wave-guide, providing less space for the feeds as show in FIGS. 3*a,b*.

FIGS. 7*a,b,c,d* show another embodiment that uses a cross radiator oriented such that the larger adjacent feeds can be located even closer. In this particular example the horizontal length between extreme opposing corners is only 0.478" for a cross radiator designed for 12.2-12.7 GHz. In addition if the adjacent feeds are elliptical or circular in shape they can be even closer because the cross radiator is extremely narrow along the horizontal line that the feed centers lie on. This is even more pronounced if the adjacent feeds are diamond shaped as shown in FIGS. 7*c,d*.

In a particular embodiment, the first feed horn receives a beam in the frequency band of 12.2-12.7 GHz (Ku BSS band) from a satellite located at 101 degrees west longitude, the second feed horn receives a beam in the frequency band of 18.3-18.8 and 19.7-20.2 GHz (Ka band) from a satellite located at 102.8 degrees west longitude, and a third feed horn receives a beam in the frequency band of 18.3-18.8 and 19.7-20.2 GHz (Ka band) from a satellite located at 99.2 degrees west longitude.

Recall that a typical CP polarizer simply introduces a 90 deg phase differential between the 2 orthogonal linear components that comprise circular polarity. For all of the cross sections discussed as possible embodiments a circular polarity "CP" polarizer can be added and/or in some cases integrated to this small radiator structure.

FIGS. 8*a-b* provide examples of this consisting of a small horn section followed by a circular waveguide polarizer section in which orthogonal sets of walls transition at different rates along the length of the polarizer so that the height does not equal the width of the waveguide cross-section over an appropriate length in order to introduce the needed 90 deg phase differential is introduced. In these examples relatively smooth transitions were used along the length of the polarizer but abrupt steps can be used instead in order to reduce length. Obviously traditional metal septums, irises and dielectric polarizers can be used as well to introduce the needed phase shift. Many approaches can be integrated (small radiator and polarizer) into a single die-casting possibly including the LNB (low noise block down converter) housing, or simply connect to an OMT (orthogonal mode transducer). FIGS. 8*a-b* also include a CP polarizer as part of the transition from small radiator to output wave-guide. Near the middle of the transition/polarizer, the x-section width is greater than the height. This in combination with the correct length provides the mechanism to introduce the 90 deg phase differential needed for good CP conversion and cross polarization performance (x-pol isolation).

The invention claimed is:

1. An antenna configured to simultaneously receive signals from multiple satellites that are closely spaced from the perspective of the antenna; comprising:

at least three closely spaced antenna feed horns arranged in a substantially linear array along a linear axis;

a substantially elliptical reflector defining a major axis for feeding signals to the closely spaced antenna feed horns;

a first feed horn of the array having an exterior contour that defines a first indentation;

a second feed horn of the array having an exterior contour that defines a portion received within the first indentation of the first feed horn; and wherein the linear axis of the array is substantially aligned with the major axis of the reflector.

2. The antenna of claim 1, wherein the three closely spaced antenna feed horns are disposed within a common housing.

3. The antenna of claim 2, wherein the common housing further comprises a low noise block down converter.

4. The antenna of claim 2, wherein the common housing further comprises a circular polarizer.

5. The antenna of claim 1, herein the first feed horn defines a second indentation, further comprising a third feed horn having an exterior contour that defines a portion received within the second indentation of the first feed horn.

6. The antenna of claim 5, wherein the first feed horn comprises a substantially cross shape.

7. The antenna of claim 6, wherein the second and third feed horns each comprise a substantially square or rectangular shape.

8. The antenna of claim 6, wherein the second and third feed horns each comprise a substantially round or oval shape.

9. The antenna of claim 6, wherein the second feed horn comprises a substantially round or oval shape and the third feed horn comprises a substantially square or rectangular shape.

10. The antenna of claim 1, wherein the first feed horn comprises a substantially cross shape.

11. The antenna of claim 10, wherein the second feed horn comprises a substantially square or rectangular shape.

12. The antenna of claim 10, wherein the second feed horn comprises a substantially round or oval shape.

13. An antenna configured to simultaneously receive signals from multiple satellites that are closely spaced from the perspective of the antenna; comprising:

a common housing containing at least three closely spaced antenna feed horns arranged in a linear array along a linear axis, a low noise block down converter, and a circular polarizer;

a substantially elliptical reflector defining a major axis for feeding signals to the closely spaced antenna feed horns;

a first feed horn of the array having an exterior contour that defines a first indentation; and a second feed of the array horn having an exterior contour that defines a portion received within the first indentation of the first feed horn; and wherein the linear axis of the array is substantially aligned with the major axis of the reflector.

14. The antenna of claim 13, wherein the first feed horn defines a second indentation, further comprising a third feed horn having an exterior contour that defines a portion received within the second indentation of the first feed horn.

15. The antenna of claim 14, wherein the first feed horn comprises a substantially cross shape.

16. An antenna configured to simultaneously receive signals from multiple satellites that are closely spaced from the perspective of the antenna, comprising:

a common housing containing at least three closely spaced antenna feed horns arranged in a substantially linear array along a linear axis and a low noise block down converter;

a substantially elliptical reflector defining a major axis for feeding signals to the closely spaced antenna feed horns;

a first feed horn of the array having an exterior contour that defines first and second indentations;

a second feed horn of the array having an exterior contour that defines a portion received within the first indentation of the first feed horn; and a third feed horn of the array having an exterior contour that defines a portion received within the second indentation of the first feed horn; and wherein the linear axis of the array is substantially aligned with the major axis of the reflector.

* * * * *